US006779675B2

(12) United States Patent
Cousseau

(10) Patent No.: US 6,779,675 B2
(45) Date of Patent: Aug. 24, 2004

(54) MOULDED TUBULAR CARTRIDGE WITH CONTROLLED TEARAWAY OPENING

(75) Inventor: Pierre Cousseau, Chevigny Saint Sauveur (FR)

(73) Assignee: Manufacture Bourguignonne de Plastiques, Sennecey les Dijon (FR)

( * ) Notice: Subject to any disclaimer, the term of this patent is extended or adjusted under 35 U.S.C. 154(b) by 0 days.

(21) Appl. No.: 10/203,377

(22) PCT Filed: Feb. 9, 2001

(86) PCT No.: PCT/FR01/00372

§ 371 (c)(1),
(2), (4) Date: Nov. 25, 2002

(87) PCT Pub. No.: WO01/58769

PCT Pub. Date: Aug. 16, 2001

(65) Prior Publication Data

US 2003/0183634 A1 Oct. 2, 2003

(30) Foreign Application Priority Data

Feb. 9, 2000 (FR) ..... 00 01589

(51) Int. Cl.[7] ..... B65D 17/34; B65D 17/40

(52) U.S. Cl. ..... 220/270; 220/276; 220/269

(58) Field of Search ..... 220/258.2, 258.5, 220/266, 269, 270, 276, 257.1, 257.2, 265; 222/153.07, 541.9; 215/253, 255, 256, 298, 305

(56) References Cited

U.S. PATENT DOCUMENTS 2,601,937 A * 7/1952 Ottesen ..... 220/276
3,415,412 A * 12/1968 Robinson et al. ..... 220/270
RE27,611 E * 4/1973 Song ..... 220/270
3,750,820 A * 8/1973 Labarre ..... 215/253
3,967,754 A 7/1976 Ostrem
RE29,850 E * 11/1978 Labarre ..... 222/541.9
4,171,062 A * 10/1979 Allen et al. ..... 220/270
4,438,864 A * 3/1984 Helms ..... 220/265
4,442,949 A * 4/1984 Dwinell et al. ..... 220/257.2
4,687,116 A * 8/1987 Dutt et al. ..... 220/270
4,702,387 A 10/1987 Wombold
5,511,679 A * 4/1996 Beck ..... 220/270
5,511,680 A * 4/1996 Kinne ..... 206/276
5,713,484 A * 2/1998 Setty ..... 220/790
6,179,147 B1 * 1/2001 Mogard et al. ..... 220/258.2

* cited by examiner

*Primary Examiner*—Nathan J. Newhouse
*Assistant Examiner*—James Smalley
(74) *Attorney, Agent, or Firm*—Young & Thompson

(57) ABSTRACT

The invention concerns a cylindrical cartridge (1) made of moulded material for use in a grease dispenser, closed on one side with a cap and the other with a frangible lid (2), characterized in that the lid (2) shaped like a disc (4) enclosed with a skirt (5) extending thereabove, over a constant height h, is secured to the end of the cartridge by a tearaway film (6) linking it to the outer edge **(5*a*) of the skirt (5) which comprises a cut (7) over its length extending on the disc to form a radial cutout (8) whereof the outer edges support two equal vertical flanks (9), arranged facing each other, secured to the sides of the cutout (7) edges and linked at their free edges by a tearaway film (10) providing the lid with tightness, a thread (11) emerging from the flanks (9)** to form the pull-ring.

7 Claims, 1 Drawing Sheet

MOULDED TUBULAR CARTRIDGE WITH CONTROLLED TEARAWAY OPENING

BACKGROUND OF THE INVENTION

The present invention relates to a system for opening the frangible bottom of a cylindrical cartridge moulded from degradable plastics material more particularly intended for pasty products such as greases or the like.

Cartridges of such pasty products are already known, which comprise a tubular body closed, at one of its ends, by a bottom moulded with the lateral wall of the body and, at its other end, by a removable cap obturating the outlet orifice of the cartridge. Such cartridges are intended to be used with apparatus such as dispenser guns. To that end, the user previously tears off the bottom of the cartridge to allow the introduction through the passage thus formed of a piston delivering towards the outlet orifice the pasty product contained in the cartridge.

The necessary recycling of the material used for the manufacture of such cartridges has led to replacing the PVC by biodegradable products such as polyethylene; in the same way as the PVC formerly used for the cartridges was easily cut in order to open the bottom, polyethylene does not lend itself easily to the cut-outs of the bottom made with current blunt objects. One has therefore been rapidly led to seeking solutions for easy opening of the bottoms of polyethylene cartridges, which remain economically acceptable.

To this end, a solution has already been proposed by Applicant in his French Patent FR 2 709 732 in which the bottom of the grease cartridge is linked to the wall of the tubular body of said cartridge by a connection zone of lesser resistance so that its separation from the tubular body at the moment of use thereof in a dispenser gun procures a neat passage through which can be engaged the piston of the gun which ensures delivery of the grease outside the cartridge. According to this Patent, the bottom of the cartridge is constituted by a band extending spirally and flat from a central point, the turns being contiguous and joined by a line of lesser resistance, so that, by pulling at the centre of the bottom of the cartridge by means of a gripping member, the bottom of the cartridge is progressively cut open. Although such a device is particularly adapted to degradable materials such as polyethylene, it nonetheless presents numerous drawbacks: the cartridge is opened by successive jerks when the successive turns are detached and, in addition, the spirally wound ribbon thus obtained is torn all at once from the periphery of the tubular body of the cartridge, which has the unpleasant effect of projecting, at the moment of release of the band which then behaves like a spring, the residual grease present on that face of the spiral which was in contact with the grease before opening.

SUMMARY OF THE INVENTION

The present invention has for an object to contribute a clear improvement to this system of frangible opening of a cylindrical cartridge for pasty product or the like, moulded from a plastics material and adapted to be used in a dispenser gun incorporating piston as tubular body, to ensure, in cooperation with said piston the progressive delivery of the pasty product through one or the ends of said cartridge normally obturated before use by a cap, the other end of the tubular body being, before use, closed by a frangible lid moulded with the lateral wall of the body and of which the detachment by a pull ring procures, as in the prior art cited, a neat passage ensuring free circulation of the product delivered by the piston.

According to the invention, this cylindrical cartridge is noteworthy in that the lid which has the general shape of a disc which is substantially planar at least on its inner face, surrounded by a vertical skirt which extends from and above its outer face, over a constant height, substantially perpendicular to the plane of the disc, is secured to the inner face of the corresponding end of the tubular body or of the piece which acts as such, by a tearaway film made of moulded matter linking it to the outer face of the upper end of the skirt, the latter comprising at a point of its circumference a vertical cut over the whole of its height extending horizontally on the disc over a substantially equal distance to form a radial cutout of which the banks support two substantially equal vertical flanks, preferably parallellepipedic and disposed opposite each other, of thickness at least equal to that of the skirt and of the same height, secured vertically to the banks of the vertical cut and linked together by their opposite outer free edges by a tearaway film of moulded matter forming the seal of the lid, a thread of moulded matter of appropriate shape emerging from the outer face of one of the flanks, on the side located opposite its attachment to the skirt in order to be secured symmetrically on the other side to the outer face of the other flank to form the outer pull ring.

The interest of this new solution will be readily understood, whereby the flat cut-out band proposed in the prior art is replaced by a simple detachable lid provided with an adequate cutout making it possible to create a zone of privileged upward bending of the detachable part of the lid concentrating the efforts of pull at the level of said cutout, which provokes tear at that precise point and then allows a progressive detachment on either side of the cutout, thus limiting, if not avoiding, the spring effect feared in the prior art.

This solution is particularly advantageous since it makes it possible, for the same effort, to obtain detachment of the lid more easily by concentrating all the effort at the same point instead of distributing it over a broad sector of angle of the lid, as known on the majority of previously known frangible openings.

BRIEF DESCRIPTION OF THE DRAWINGS

Other characteristics and advantages will appear more readily from the description of a cartridge moulded from biodegradable material such as polyethylene provided with a frangible opening according to the invention which is given hereinafter by way of non-limiting example of the invention with reference to the accompanying drawings, in which.

DETAILED DESCRIPTION OF THE PREFERRED EMBODIMENTS

Figure 1:
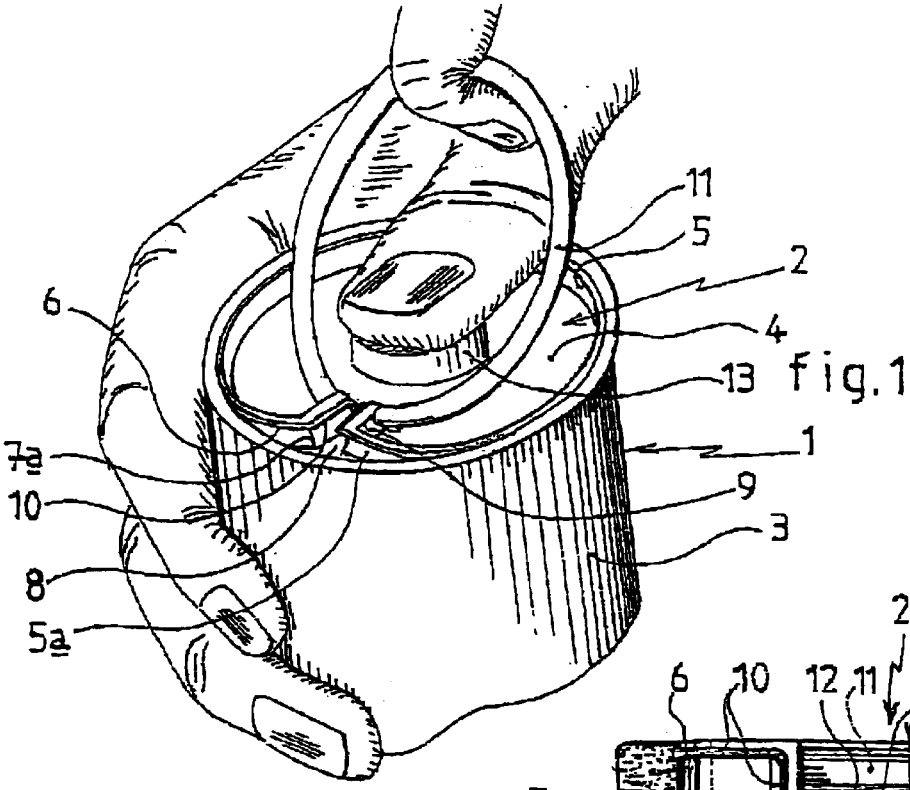
FIG. 1 is a view in perspective showing the operation of opening of the lid of the cartridge in the initial phase of pulling.
Figure 4:
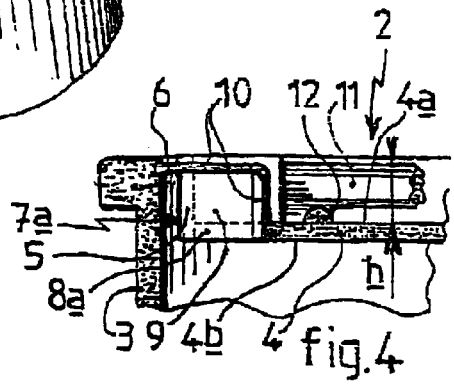
FIG. 4 is a partial section along line IV—IV of FIG. 2 and on a larger scale of the system of opening of the lid proposed by the invention.

With reference to FIG. 1, the cartridge 1 is closed at one of its ends by a cap (not shown in the FIGS.). At the other end of the cartridge 1 and moulded with the same cartridge, made of a biodegradable material such as polyethylene, a lid 2 is provided to obturate the cylindrical body 3 of the cartridge 1 in sealed manner. To that end, the lid 2 is constituted by a plate of moulded matter forming obturator having the shape of a disc 4, of thickness advantageously identical to that of the tubular body 3 and substantially planar, at least concerning its inner face in its most general variant (not shown in the FIGS.), surrounded by a vertical skirt 5 which extends over the whole periphery of the disc, from and above its outer face 4*a* over a constant height h which will be explained hereinbelow, substantially perpendicular to the plane of the disc 4; this lid 2 is secured to the inner face of the corresponding end of the tubular body 3 by a tearaway film 6 of moulded matter, linking it to the upper outer edge 5*a* of the skirt 5. According to an essential characteristic of the invention, the skirt 5 comprises at a point on its circumference, a vertical cut 7 (FIG. 1) over its whole height h extending horizontally on the disc 4 over a distance substantially equal to the height h of the skirt to form a radial cutout 8 (shown in plan in FIG. 3) of which the banks 8*a* and 8*b* (FIG. 3) support on the outer side 4*a* of the disc 4 two vertical flanks 9, of normally identical shape, preferably parallelepipedic and of thickness at least equal to that of the skirt 5 and of the same height, secured vertically on one side to the banks 7*a* (FIG. 4) of the vertical cut 7 and linked together by their horizontal and vertical, outer free edges, facing each other, by a tearaway film 10 of moulded matter forming the seal of the lid 2 at the location of its cutouts 7 and 8 and in combination with the tearaway film 6 linking, as has been seen, the whole of the lid to the inner face of the end of the tubular body 3. A thread of moulded matter 11 of appropriate shape, as shown in perspective in FIG. 1, is connected to the outer face of a first vertical flank 9, on the side opposite its line of attachment to the skirt 5 and is linked symmetrically by its other end to the outer face of the second vertical flank 9, to form an outer pull ring; the length of the pull ring 11 will be sufficiently great to be able to slide the first phalanx of a user's finger as shown in FIG. 1 and, on the contrary, limited so that, at rest, said ring 11 is totally inscribed inside the lid 1 as shown in FIGS. 2 and 4; according to a preferred variant of the invention, the cross-section of the thread 11 of the pull ring is rounded on its inner face in order to soften the grip at the moment when the cartridge is opened.

According to a secondary characteristic of the invention and with reference to FIG. 2, a bead 12 moulded thereon extends on the outer face 4*a* of the disc 4 substantially in arc of circle to link the zones of attachment of the ring 11 to the flanks 9 and thus reinforce its fixation to the lid, avoiding an untimely radial tear during the whole phase of pulling with a view to withdrawal thereof, as will be stated hereinbelow.

Figure 2:
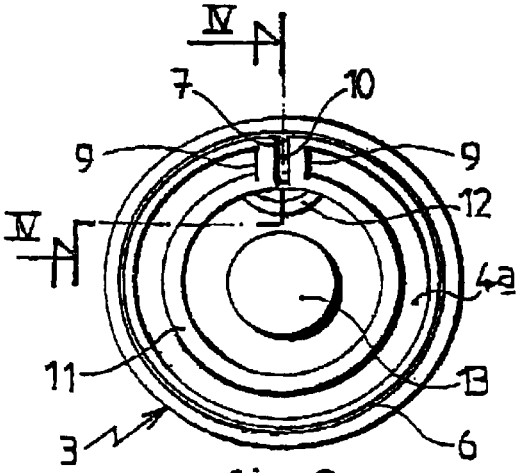
FIG. 2 is a plan view of the cartridge provided with its frangible lid in non-detached storage position.
Figure 3:
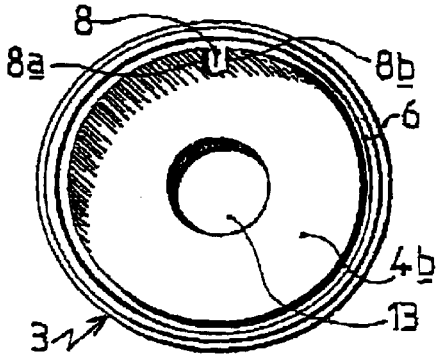
FIG. 3 is a view from underneath of the frangible lid of the cartridge according to the invention.

Similarly, with reference to FIGS. 2 and 3, it is advantageous to provide an advantageously circular boss 13 rising above the outer face 4*a* of the disc 4 over a height similar to, although less than the height h of skirt, its diameter being such that the boss 13 is always inside the ring 11 when it is at rest, i.e. before opening of the lid 2. It goes without saying that the boss 13 is in relief at the centre of the lid 2 and is therefore presented as a hollow on the inner face 4*b* of the lid 2 in accordance with the representation of FIG. 3, and this for an obvious saving of matter.

The succession of the steps participating in the tearing of the frangible lid 2 before use of the cartridge thus equipped, in a gun dispensing, for example, grease or the like, will now be described.

As shown in perspective in FIG. 1, the operator holds in the hollow of his hand the body 3 of the cartridge 1, positioning his thumb either at the centre of the outer face 4*a* of the disc 4 or, as in the variant shown in FIG. 1, on the boss 13 which thus participates more efficiently in the movement of leverage at the moment of pulling on the ring 11 for tearaway; it is true that the boss 13 procures a rigidification of the disc 4 of the lid 2, which further accentuates the shear effect procured by the cutouts 7 and B at the moment of pulling. To that end, when the user pulls the ring 11 as shown in FIG. 1, the effort of lift is completely transmitted to the two flanks 9 surrounding the two respectively vertical and radial cutouts 7 and 8; this effort applied to the anchoring points of the ring 11 has the effect of separating the flanks 9 from each other and of provoking in a first step the tear of the film 10 thus provoking a very localised incipient tear on either side of the vertical cut 7 on the skirt 5, concentrating all the efforts at this same point on the film 6 linking the upper edge of the skirt 5 and the end of the tubular body 3 of the cartridge 1. The concentration of this effort in the pulling then provokes an incipient tear of the film 6 on either side of the vertical cut 7, which makes it possible for the disc 4 to incurve upwardly like a bird's wing without stress of inflection by reason of the horizontal cutout 8, procuring a symmetrical and progressive detachment of the lid 2 along the upper end of the tubular body 3, without jerks or spring effect as in the prior art.

The bead 12 contributes to avoiding an untimely radial tear of the disc 4 by extending the horziontal cutout 8, which would have the effect of offsetting the efforts of pulling on the ring 11 and creating an uncertain tear of the film 6.

It goes without saying that such an opening comprising a frangible lid according to the invention might be adapted to any form of cylindrical cartridge made of a moulded material; according to another configuration of the invention, the frangible lid 2 may be provided to be mounted on the head of a circular cap (not shown in the FIGS.) which is then secured or welded to the free end of the tubular body 3 of a cartridge 1.

What is claimed is:

1. A cylindrical cartridge having a frangible lid for removably sealing an end of the cylindrical cartridge made of entirely moulded plastics material constituting the tubular body of a dispenser of pasty product through another end normally obturated before use by a cap, said frangible lid being moulded with a lateral wall of the tubular body and comprises:

a substantially planar disc-shaped main body having an outer face;

a vertical skirt extending from and above said outer face, over a constant height, substantially perpendicular to a plane of the disc;

a tearaway film forming a seal of the lid by securing an inner face of a corresponding end of the tubular body, such that said tearaway film links an outer face of the skirt to the inner face, said skirt comprising, at a point of a circumference of said skirt, a vertical cut over an entirety of said height, said cut extending radially on the disc over a distance substantially equal to said height and comprising a radial cutout having opposing sides, each of said sides supporting, on the outer face of the disc, a respective one of two vertical flanks, such that said vertical flanks are disposed opposite each other on either side of said cutout, said vertical flanks having a thickness at least equal to that of the skirt and of a same height, said vertical flanks being secured vertically on a respective side of the vertical cut and linked together by opposite outer free edges by a portion of said tearaway film that extends therebetween; and a thread of moulded matter extending symmetrically from an outer face of one of said flanks to an outer face of another one of said flanks to form a pull ring.

2. The lid according to claim 1, wherein the ring has a maximum length such that, before tear of the lid, the ring is entirely included in an inner space defined by the skirt and the outer face of the disc.

3. The lid according to claim 2, further comprising a bead extending over the outer face of the disc and linking zones of attachment of the ring to the flanks and securing the ring to the lid at the moment of pulling.

4. The lid according to claim 3, further comprising a circular boss having substantially a same height as the height of said skirt and being coaxially disposed at a center of the outer face of the disc, a diameter of said boss being such that said boss is inside the ring before the ring is pulled.

5. The lid as claimed in claim 1, wherein the lid is mounted on a head of a circular cap secured to a free end of the cartridge.

6. The lid according to claim 1, wherein the pasty product contained under said lid is grease.

7. A frangible lid for removably sealing an end of a cylindrical cartridge, said frangible lid being moulded with a lateral wall of the cartridge and comprises:

a substantially planar disc-shaped main body having an outer face;

a skirt extending outwardly from said outer face, over a constant height, substantially perpendicular to a plane of the disc, said skirt comprising, at a point of a circumference of said skirt, a cut over an entirety of said height, said cut extending radially on the disc over a distance substantially equal to said height, so that said disc has a radial cutout having opposing sides, each of said sides supporting, on the outer face of the disc, a respective one of two vertical flanks, such that said vertical flanks are disposed opposite each other on either side of said cutout;

a tearaway film forming a seal of the lid by securing an inner face of a corresponding end of the cartridge, such that said tearaway film links an outer face of the skirt to the cartridge, said vertical flanks being secured vertically on a respective side of the vertical cut and linked together at opposite outer free edges by a portion of said tearaway film that extends therebetween, said tearaway film covering said cutout; and a pull ring connected to a respective outer face of said flanks.

* * * * *